United States Patent [19]

Schultz

[11] Patent Number: 4,598,797

[45] Date of Patent: Jul. 8, 1986

[54] TRAVEL/LIFT INHIBIT CONTROL

[75] Inventor: Donald L. Schultz, Richland, Mich.

[73] Assignee: Clark Equipment Company, Buchanan, Mich.

[21] Appl. No.: 599,938

[22] Filed: Apr. 13, 1984

[51] Int. Cl.[4] ..... B66B 9/20

[52] U.S. Cl. ..... 187/9 E; 180/271

[58] Field of Search ..... 187/9 E, 9 R, 17; 180/271, 282, 170; 318/489, 466–468; 60/427

[56] References Cited

U.S. PATENT DOCUMENTS

| | | | |
|---|---|---|---|
| 2,751,994 | 6/1956 | Remde | 180/282 |
| 3,475,061 | 10/1969 | Steinkamp et al. | 180/271 |
| 3,524,522 | 8/1970 | Thomas et al. | 187/9 E |
| 3,795,285 | 3/1974 | Scholl et al. | 180/271 |
| 3,993,166 | 11/1976 | Senour | 187/9 R |
| 4,265,337 | 5/1981 | Dammeyer | 187/9 E |

*Primary Examiner*—Joseph J. Rolla

*Assistant Examiner*—Kenneth Noland

*Attorney, Agent, or Firm*—Reising, Ethington, Barnard, Perry & Milton

[57] ABSTRACT

A lift truck of the order-picker type is provided with an automatic control system for safe-guarding the operation against certain conditions. The electronic control system is responsive to an electrical height signal corresponding to the height of the lift fork to regulate or limit the other operational functions of the truck. The speed control channel compares the speed signal with a speed command signal and produces a speed control signal of limiting value. A travel interrupt channel compares the height signal with the steering angle and interrupts the vehicle travel if the steering angle is excessive. Usually, the high speed lift is cut-off when a predetermined height is reached; the lowering of the upright is disabled at a predetermined lower limit subject to manual override.

10 Claims, 10 Drawing Figures

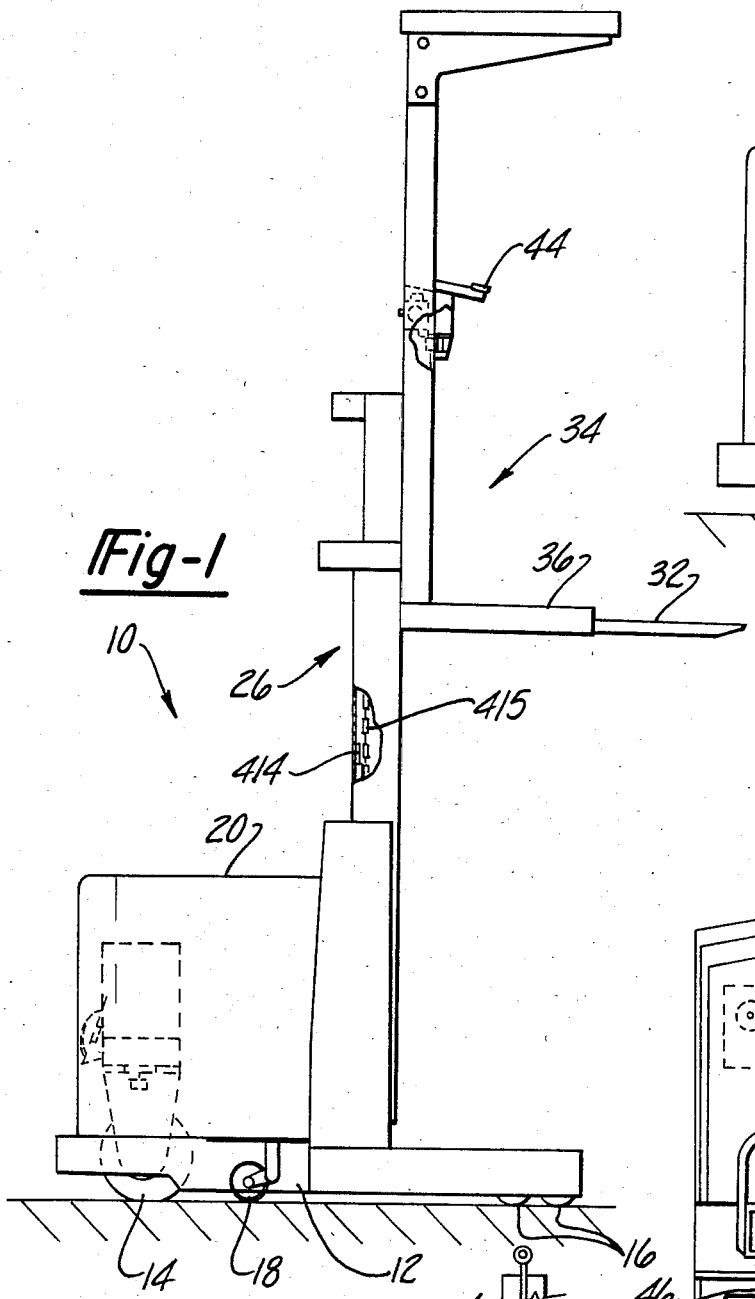
Fig-1
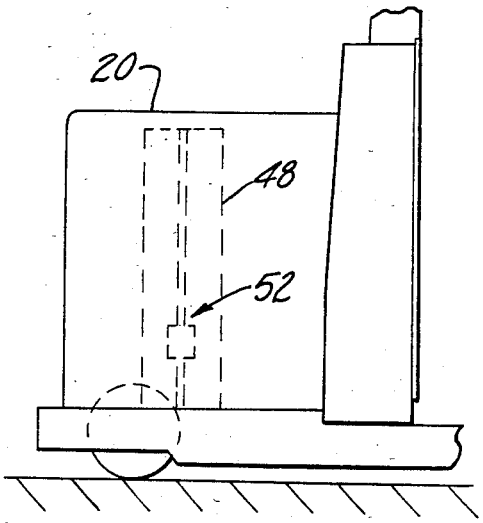
Fig-2
Fig-3
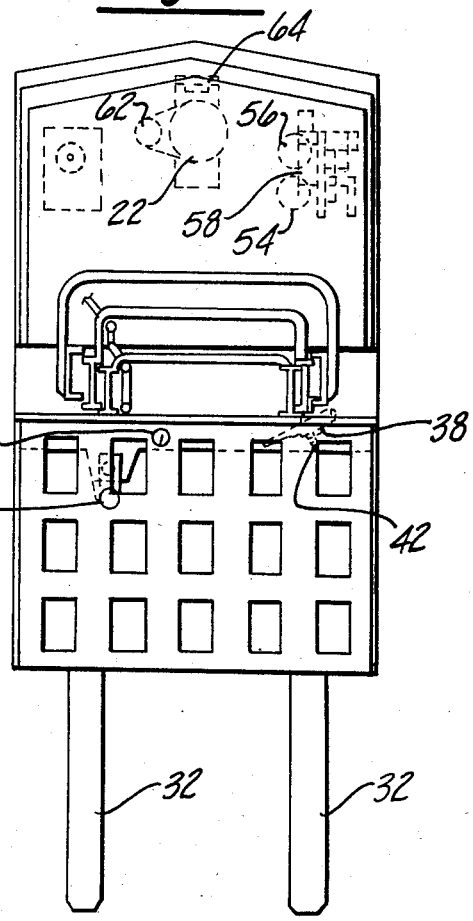
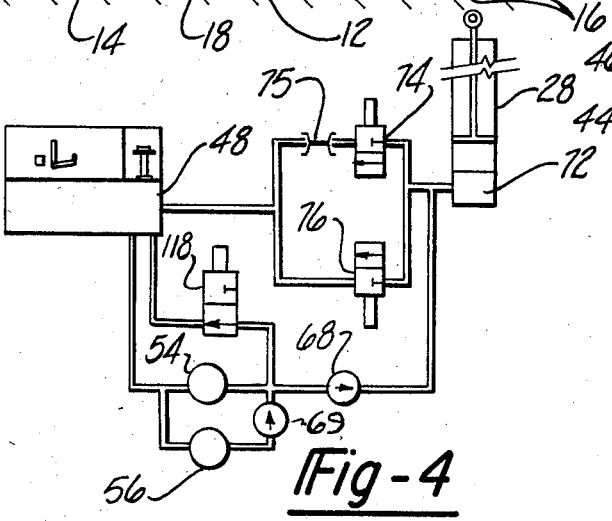
Fig-4

TRAVEL/LIFT INHIBIT CONTROL

FIELD OF THE INVENTION

This invention relates to industrial lift trucks and more particularly to an automatic control system for governing the lift function and the travel of the truck to enhance the safety of operation.

BACKGROUND OF THE INVENTION

In certain types of industrial operations, such as warehousing, it is common practice to use a lift truck of the type known as an order-picker truck. Such trucks provide an extendible upright for a lift fork and an operator's station on the extendible upright. The operator controls the speed and steering of the truck and the lifting and lowering of the upright from this platform. It is desirable to provide safeguards against possible injury to the operator or damage to the vehicle in the event the operator attempts to operate or load the vehicle in an unsafe manner. In some of such vehicles, it is possible for the operator to manually control the elevation of the lift fork and loading in such a manner that the vehicle becomes unstable and may overturn in the event of excessive speed or turning the vehicle too sharply.

Heretofore, it has been proposed to provide a safeguard to prevent the operator from driving too fast with the upright in an extended or elevated position. The Thomas U.S. Pat. No. 3,486,333 describes a lift truck with a manually controlled extendible upright and an automatic system for preventing extension of the upright at high speed above a predetermined height. The automatic control system of this patent utilizes a limit switch located on the upright for disabling the high speed lift operation at a predetermined height. Above this height, only low speed lift operation is available. The Thomas et al U.S. Pat. No. 3,524,522 describes a lift truck with an extendible upright and means for limiting the speed of operation of the truck as a function of the height of the upright. In the control system of this patent, a speed control device of the solid state type is provided for varying the speed of the traction motor by varying the duration of power pulses or the frequency of power pulses from a battery to the motor. The current to the motor control device, which varies the duration or frequency of the power pulses, is controlled by first and second variable resistors in series with a normally closed limit switch, the vehicle battery and a control input of the speed control device. The first variable resistor is actuated by the manual accelerator lever and has a maximum resistance in the normal or low speed position. The second variable resistor is actuated by a float in the hydraulic reservoir of the lift system so that it has a maximum resistance with the extendible upright at its maximum height. Accordingly, the maximum speed at which the motor can be operated is no greater than the speed called for by the setting of either variable resistor, whichever is lower. More particularly, speed can be no greater than the value corresponding to the sum of the resistances of the two variable resistors. When the upright reaches a predetermined height, the normally closed limit switch which is positioned on the upright is opened and the motor is effectively deenergized to stop the truck.

A general object of this invention is to provide an improved automatic speed and lift control for safeguarding the operation of an industrial lift truck.

SUMMARY OF THE INVENTION

In accordance with this invention, there is provided an automatic control system for a lift truck for safeguarding against excessive speed as a function of height and interrupts travel under certain conditions of steering angle and height. In general, this is accomplished by an electronic control system which utilizes an electronic signal corresponding to the height of the upright for regulating or limiting the other operational functions of the vehicle.

More particularly, in accordance with this invention, the electronic control system is responsive to the signal corresponding to the height of the upright to exercise one or more of the following controls: interrupt vehicle travel if the steering angle is excessive; limit the speed of the vehicle in accordance with the height of the upright; cut-off the high speed lift when the upright reaches a predetermined height; disable the lowering of the upright at a predetermined limit and permit a manual override and interrupt the high speed lowering of the upright at a predetermined height and permit manual override. Additionally, the electronic control circuit is adapted to provide an overload warning when there is an excessive load on the lift fork and the lift and lower switches are open; disable the lowering function of the upright in the event that the load forks engage an obstacle during lowering, and disable the lifting function in the event that the vehicle battery voltage is below a predetermined value.

A more complete understanding of this invention may be obtained from the detailed description that follows, taken with the accompanying drawings.

DESCRIPTION OF THE DRAWINGS

FIG. 1 is a side elevation of an industrial lift truck embodying this invention;

FIG. 2 is a side elevation of a portion of the lift truck with parts broken away;

FIG. 3 is a top plan view of the lift truck;

FIG. 4 is a schematic of the hydraulic system;

BEST MODE FOR CARRYING OUT THE INVENTION

Figure 5:
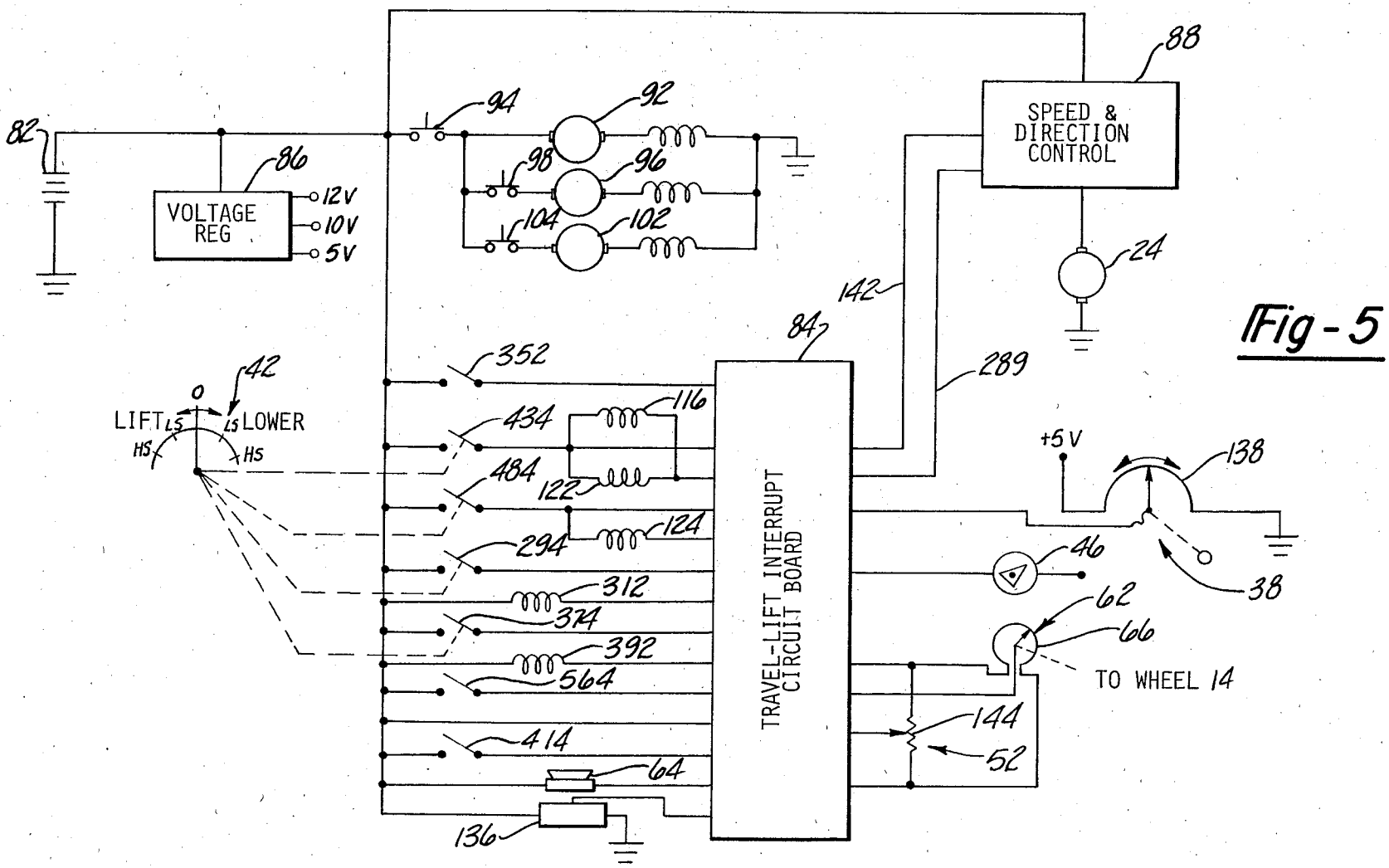
FIG. 5 is a block diagram of the automatic control system of this invention.

Referring now to the drawings, there is shown an illustrative embodiment of the invention in an industrial lift truck of the so-called "order picker" type with the operator's station mounted on the extendible upright and movable with the lift fork. The automatic control system is implemented partly in digital logic circuits of the discrete type and partly in analog circuits. It will be understood, as the description proceeds, that the invention is useful in other embodiments and applications.

As shown in FIGS. 1, 2 and 3, the lift truck includes a body 12 supported by a drive-steer wheel and a pair of tandem outrigger wheels 16 on each side. The drive-steer wheel 14 serves not only as the traction wheel for driving the vehicle but also as the dirigible wheel for steering the vehicle. A stabilizer wheel 18 is attached to each side of the body 12. A drive unit 22 for driving the drive-steer wheel 14 is mounted on the body and includes an electric traction motor 24 (see FIG. 5).

A telescopic upright 26 is also mounted on the body 12 and is powered by a piston and cylinder type single acting fluid lift motor 28 (see FIG. 4). A load engaging fork including a pair of fork arms 32 and an operator's station 34 are mounted for movement with the extendible upright. The operator's station 34 includes a platform 36 on which the operator stands during operation of the lift truck. The operator's station 34 is provided with a control panel which includes a direction and speed control handle 38. The control panel is also provided with a lift/lower control lever 42 which allows the operator to manually control the energization of the extendible upright for low speed or high speed lift and for low speed and high speed lower. Also, at the operator's station 34, a steering tiller 44 is provided for manual control of the drive-steer wheel 14. A direction indicator 46 is provided on the control panel for indicating the steering angle to the operator.

Also, as shown in FIGS. 1, 2 and 3, the hydraulic sump tank 48 is mounted on the body 12 under the hood 20. The sump tank is provided with the height sensor 52 comprising a float actuated potentiometer. The liquid level in the sump tank 48 corresponds to the height of the extendible upright 26 and the height sensor 52 produces a signal voltage corresponding to the height. Also, positioned under the hood, as shown in FIG. 3, are a low speed lift pump 54, a high speed lift pump 56 and the lowering control valve 58. A steering angle sensor 62 is belt driven by the drive unit 22 and develops an electrical signal voltage corresponding to steering angle. Also, located under the hood is an overload warning horn 64.

The hydraulic system for extending and retracting the upright 26 of the lift truck is shown in FIG. 4. For low speed lifting operation of the upright 26, the fluid motor 28 is energized by the low speed pump 54. The pump 54 has its inlet connected with the sump tank 48 and its outlet connected through a check valve 68 and the flow control valve 72 to the inlet of the motor 28. The flow control valve 72 provides substantially unrestricted flow into the motor 28 and regulates the flow out of the motor depending upon the load carried by the upright 26, i.e. the restriction to flow increases with increased load. For high speed operation of the extendible upright 26, the motor 28 is energized by both the low speed pump 54 and the high speed pump 56 which, with a check valve 69 is connected in parallel with the pump 54. A solenoid actuated, normally open, dump valve 118 is connected between the outlets of the pumps 54 and 56 and the sump tank 48. The lowering operation of the upright 26 is provided by controlled flow of hydraulic fluid from the motor 28 back to the sump tank 48. For a low speed lowering operation, the outlet of the fluid motor 28 is connected through the flow control valve 72, a solenoid operated low speed lowering valve 74 and a flow restrictor 75 to the sump tank 48. For the low speed lowering operation, the pumps 54 and 56 are deenergized and the low speed lowering valve 74 is opened. The flow of fluid from the motor 28 is restricted by the valve 74 and additionally it is restricted by the flow restrictor 75 so that the upright is lowered at a slow speed. For high speed operation, a high speed lowering control valve 76 is connected between the valve 72 and the sump tank 48. For the high speed lowering operation, the pumps 54 and 56 are deenergized, low speed lowering valve 74 remains closed and the high speed lowering control valve 76 is opened. This provides less restriction to the flow from the motor 28 and the upright is lowered at high speed.

A block diagram of the electrical control system for the lift truck is shown in FIG. 5. The vehicle and the control circuits are powered from a storage battery 82. In general, the control system comprises a travel-lift interrupt circuit board 84 which receives manual control and sensor input signals and develops output control signals for the traction motor 24 and the lift-lower control system for the extendible upright. More particularly, a voltage regulator 86 is connected across the battery 82 and develops regulated voltages at values of 12 volts, 10 volts and 5 volts for supply voltages to the electronic control circuits in the circuit board 84. A speed and direction control circuit 88 of the solid state, pulse/duration type, is connected between the battery 82 and the traction motor 24. A power steering motor 92 is connected through a control contactor 94 across the battery 82. A low speed lift pump motor 96 is connected through a contactor 98 across the battery 82 and a high speed lift pump motor 102 is connected through a contactor 104 across the battery 82. The travel-lift interrupt circuit board 84 is provided with a plurality of manually controlled inputs and sensor inputs for the purpose of developing output control signals, as will be discussed presently.

A manually controlled lift/lower override switch 352 is connected directly between the battery and the input of the circuit board 84. The lift/lower control lever 42 is manually actuable from a neutral position in a counterclockwise direction to select low speed lift at position LS and to select high speed lift at the position HS. Similarly, it is actuable in the clockwise direction to select low speed lower at the position LS and to select high speed lower at the position HS. For this purpose, the control lever is operably connected by a suitable cam arrangement to actuate the lift control switches 434, 484, 294 and 374. The lift control switch 434 is the low speed lift switch and is connected between the battery and an input of the circuit board 84. The solenoid winding 116 of the dump valve 118 and the pump contactor winding 122 for low speed pump 54 are connected in parallel between the switch 434 and an input of the circuit board 84. The lift control switch 484 is the high speed lift switch and it is connected between the battery 82 and an input of the circuit board 84. A pump contactor winding 124 for the high speed pump motor 102 is connected between the switch 484 and an input of the circuit board 84. The lowering control switch 294 is the low speed lowering switch and is connected between the battery 82 and the circuit board 84. A solenoid 312 of the low speed lower solenoid valve 74 is directly connected between the battery 82 and an input of the circuit board 84 and similarly solenoid 392 of the high speed lowering solenoid valve 74 is connected directly between the battery 82 and the circuit board 84. The lowering control switch 374 is the high speed lowering switch and is connected between the battery 82 and an input of the circuit board 84. A load sensing pressure switch 564 is connected between the battery 82 and an input of the circuit board 84. Switch 564 is normally open and is adapted to close in response to a predetermined high pressure in the fluid motor 28. A no-slack switch 414 is connected between the battery 82 and an input of the circuit board 84. The no-slack switch 414 is responsive to the slack or no-slack condition of the lift chain of the extendible upright which is actuated by the fluid motor 28. When the upright is being lifted or lowered, either with or without load, the drive chain should operate with no-slack. However, during a lowering operation, if the load fork should engage an obstacle, such as a storage bin, then the chain will become slack. This condition is sensed by the no-slack switch, the switch being closed when the chain is tight and being opened when the chain is slack. The overload warning horn 64, previously mentioned, is connected directly between the battery 82 and an input of the circuit board 84. Similarly, a battery condition sensor 136 which senses the voltage of the battery 82 is connected between the battery and ground and has an output connected to an input of the circuit board 84.

The direction and speed control handle 38 includes a potentiometer 138 for producing a speed command signal voltage. The potentiometer 138 suitably comprises a fixed resistor connected across the regulated 5 volt source and having its wiper contact connected with an input of the circuit board 84. The potentiometer is adapted to produce a speed command signal voltage which varies inversely with the desired speed, i.e. the signal voltage is high for creep speed and it is low for high speed. A speed control voltage is developed by the circuit board 84 and applied through a conductor 142 to the control input of the speed and direction control circuit 88. The steering angle sensor 62 suitably takes the form of a potentiometer 66 and is connected across terminals of the circuit board 84 for receiving a regulated voltage thereacross. The tap of the potentiometer is positioned in accordance with the direction angle of the drive/steer wheel of the truck and develops a signal voltage corresponding in polarity and magnitude with the direction and angle of the drive/steer wheel from the straight ahead direction. The tap of the potentiometer 62 is applied to an input of the circuit board 84. The height sensor 52 also includes a potentiometer 144 connected across terminals of the circuit board 84 which apply a regulated voltage thereacross. The movable tap of the potentiometer 144 develops a height signal voltage corresponding to the height of the extendible upright of the lift truck and is connected to an input terminal of the circuit board 84. The circuit board 84 will be described presently.

Figure 6:
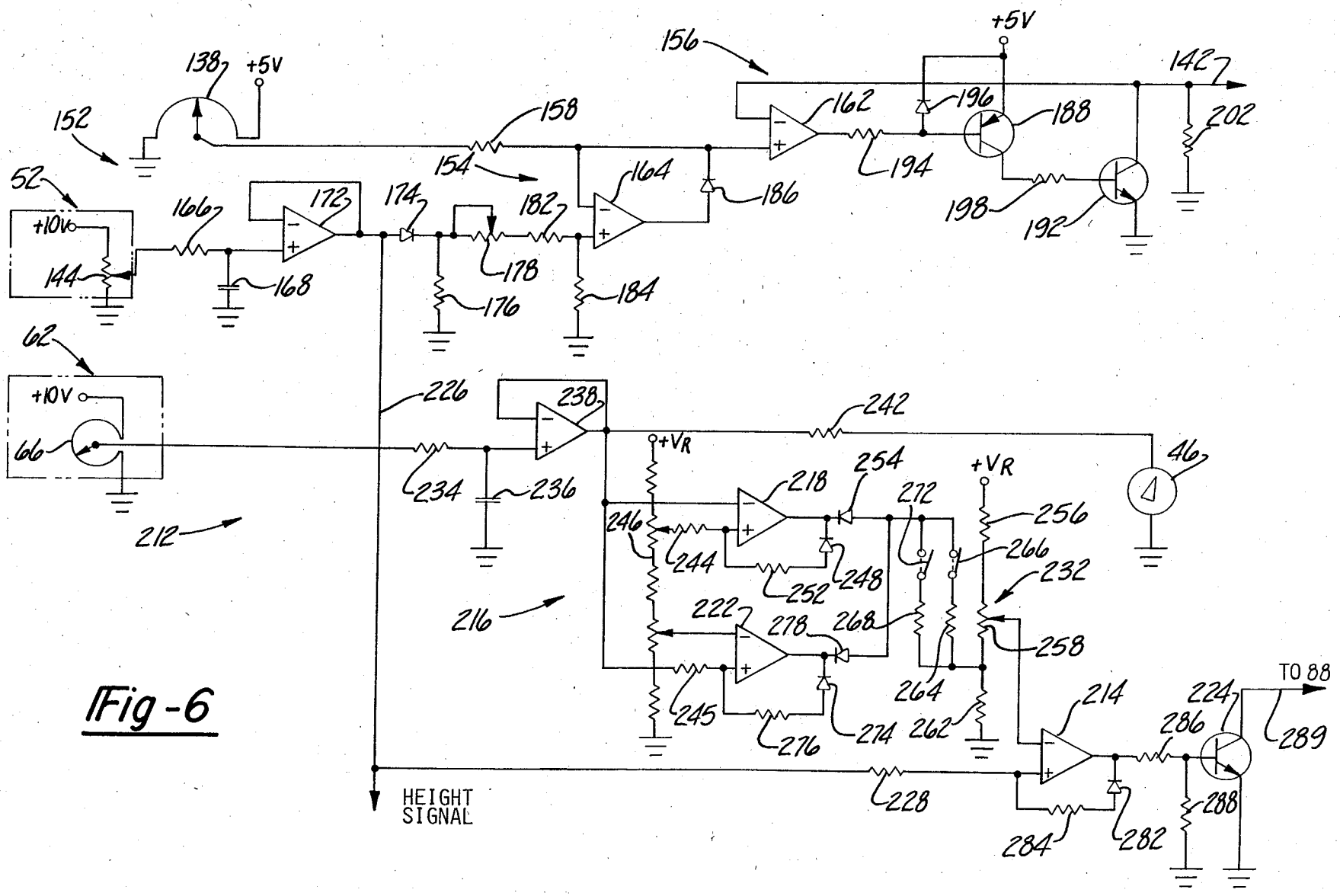
FIG. 6 is a schematic diagram of the speed control channel and travel interrupt channel.
Figure 7:
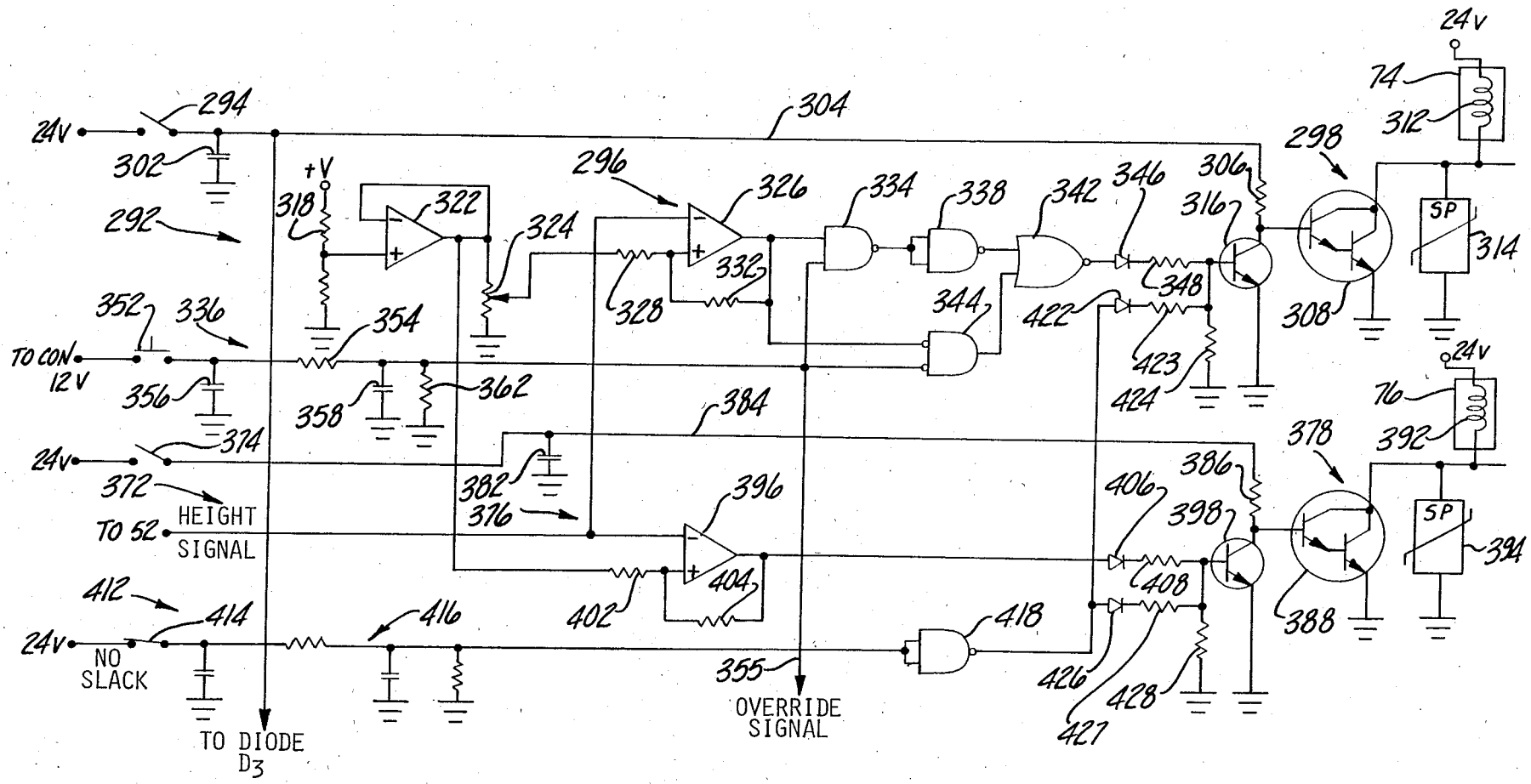
FIG. 7 is a schematic diagram of the lowering control channel and the obstruction detecting circuit.
Figures 8, 9, 10:
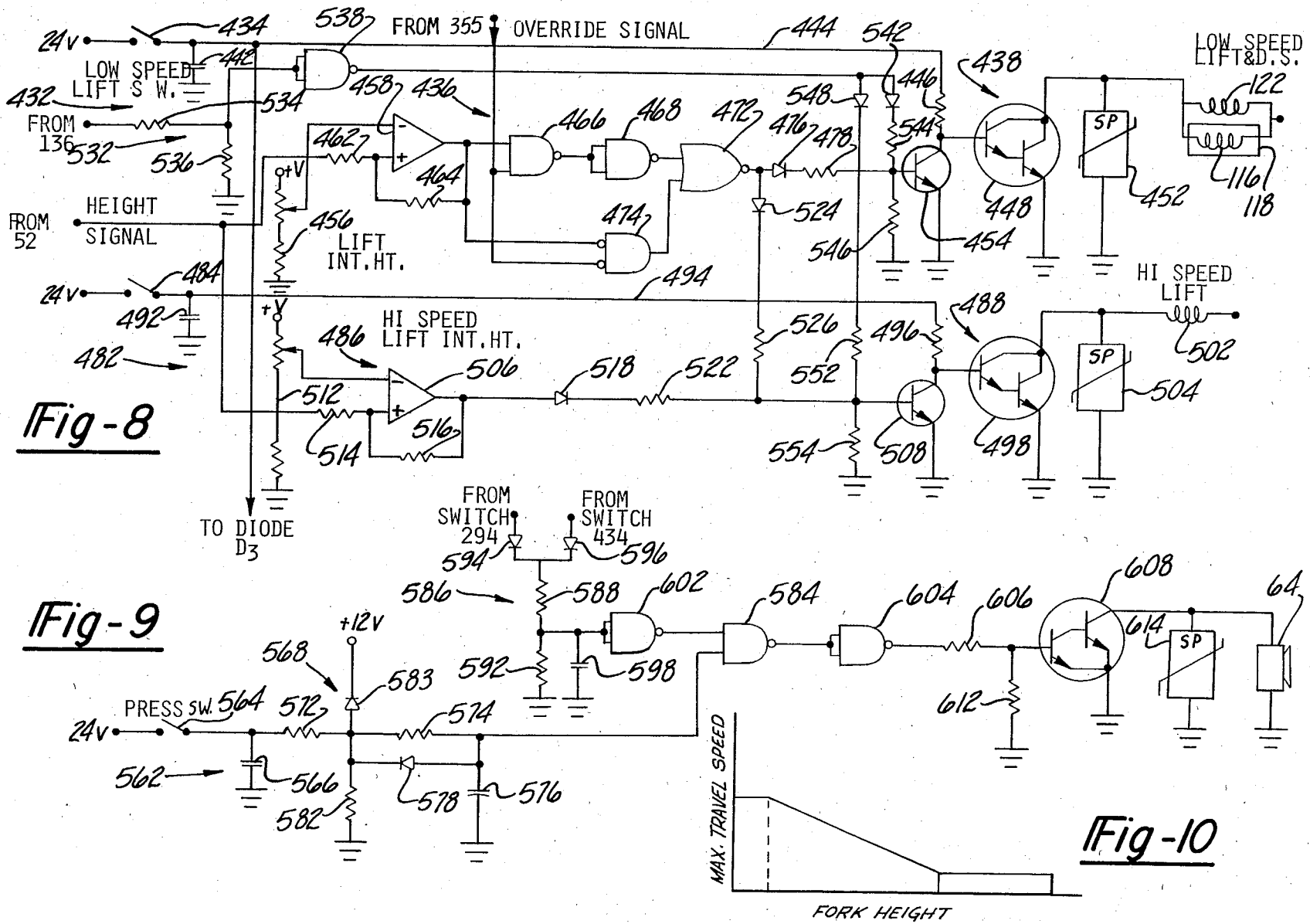
FIG. 8 is a schematic diagram of the lift control channel and the battery condition detecting circuit.
FIG. 9 is a schematic diagram of the overload warning circuit.
FIG. 10 is a chart to aid the explanation of operation.

The circuit board 84 comprises a speed control channel and travel interrupt channel, as shown in FIG. 6, a lower control channel and obstruction interrupt circuit as shown in FIG. 7, a lift control channel and battery condition detecting circuit as shown in FIG. 8, and an overload warning circuit as shown in FIG. 9. These circuits, which make up the circuit board 84, will now be described in detail.

Referring now to FIG. 6, the speed control channel 152 will now be described. This channel receives, as input, the speed command signal from the potentiometer 138 which, as discussed previously, is actuated by the manual direction and speed control handle 38. This channel also receives, as input, the height signal from the potentiometer 144 of the height sensor 52. The speed control channel 152 comprises a signal selector circuit 154 and a speed signal amplifying circuit 156. The speed command signal on the wiper contact of the potentiometer 138 is applied through a resistor 158 to the noninverting input of an operational amplifier 162 in the amplifying circuit 156. The speed command signal is also applied through the resistor 158 to the inverting input of an operational amplifier 164 which functions as a reference switching comparator, as will be discussed presently. The height signal from the potentiomenter 144 is applied through an input filter comprising a series resistor 166 and shunt capacitor 168 to the noninverting input of an operational amplifier 172 which is connected to function as a unity gain, impedence matching amplifier. The output of the operational amplifier 172 is the height signal and is applied across the diode 174 and a resistor 176 which functions as a noise suppression circuit. The voltage at the node between the diode 174 and resistor 176 is applied across a voltage divider comprising a variable resistor 178 and fixed resistors 182 and 184. The voltage at the node between resistors 182 and 184 is applied to the noninverting input of the operational amplifier 164. The ouput of the operational amplifier is connected through a diode 186 to the noninverting input of the operational amplifier 162. The operational amplifier 164 functions in such a manner that a speed control signal is applied to the noninverting input of the operational amplifier 162, the speed control signal being either the speed command signal or a modified height signal whichever is greater, as will be described presently.

The speed signal amplifying circuit 156 comprises the operational amplifier 162 which receives the speed control signal on its noninverting input. It also comprises a power amplifier including transistors 188 and 192. The output of the operational amplifier 162 is applied through a resistor 194 to the base of the transistor 188. The emitter of the transistor 188 is connected with the regulated 5 volt power supply and a diode 196 is connected between the base and emitter. The collector of the transistor 188 is connected through a resistor 198 to the base of the transistor 192. The collector of the transistor 192 is connected across an output resistor 202 and the emitter is connected to ground. The collector of the transistor 192 is also connected to the inverting input of the operational amplifier 162. In this arrangement, the operational amplifier 162 functions as a unity gain noninverting amplifier. The speed control signal is thus developed across the transistor 192, i.e. the voltage at the collector of the transistor 192 follows the voltage applied to the noninverting input of the operational amplifier 162. The speed control signal is applied to the control input of the speed and direction control circuit 88 on conductor 142, as discussed with reference to FIG. 5.

The operation of the speed control channel 152 will now be described with reference to FIG. 6 and further reference to the graph of FIG. 10. It should be noted at the outset that the operational amplifier 164 operates as a reference switching comparator such that the output thereof is applied to the noninverting input of the operational amplifier 162 only if the modified height signal at the noninverting input of amplifier 164 is greater than the speed command signal at the inverting input of the amplifier 164. In this case, the output of the amplifier 164 is applied through the diode 186 in the forward direction to the noninverting input of operational amplifier 162. On the other hand, if the speed command signal at the inverting input of amplifier 164 is greater, the output of the operational amplifier 164 is negative and it is blocked by the diode 186 from the noninverting input of amplifier 162. Thus, the speed control signal at the noninverting input of amplifier 162 is either the speed signal from the potentiometer 138 or the modified height signal from the amplifier 164, whichever is greater. It is noted that the speed command signal from the potentiometer 138 varies inversely with the desired speed, i.e. the highest voltage corresponds to the lowest speed and the lowest voltage corresponds to the maximum speed. This operation is depicted in the graph of FIG. 10. In this graph, the ordinate represents the truck speed ranging from zero to maximum speed, say five miles per hour with creep speed at one mile per hour. The height of the extendible upright, which is indicated as fork height above the floor, is shown as ranging from zero to 240 inches. For fork height up to 24 inches full speed of the truck is permitted. In this range, the speed command signal from the potentiometer 138 is greater than the modified height signal even when the operator actuates the direction and speed control lever to the maximum speed position which produces the lowest speed command signal. At a fork height of 24 inches, the modified height signal becomes greater than the speed command signal for full speed and accordingly, the output of the operational amplifier 164 corresponds to the modified height signal which is applied through the diode 186 to the noninverting input of the amplifier 162. Thus, the height signal prevails over the speed command signal to produce the speed control signal at the noninverting input of amplifier 162. Thus is applied to the speed signal amplifier circuit 156 to the speed and direction control circuit 88 and the decreased value of the speed control signal causes reduction in the truck speed. As shown by the graph of FIG. 10, the truck speed increases as a function of fork height between the fork height of 24 inches and the fork height of 180 inches. The slope of this portion of the graph is preset by the adjustment of the variable resistor 178. It can be seen from the graph that the speed control channel operates so that the maximum permitted speed of the truck is limited by the fork height. When the fork height reaches 180 inches, the truck is allowed to operate at creep speed only. The travel of the truck is further limited by the travel interrupt control channel which will be described presently.

The travel interrupt control channel 212 will now be described with reference to FIG. 6. In general, this channel is operative to stop or interrupt the travel of the truck, whether it is in forward or reverse drive, when the driver turns the truck at too sharp an angle for the existing height of the load forks. The height at which travel is interrupted varies inversely with the steering angle. In general, the travel interrupt control channel 212 comprises a comparator 214 which receives the height signal from the height sensor 52. A steering signal circuit 216 comprising a pair of comparators 218 and 222 develops a steering reference signal which is also applied to the comparator 214. The output of the comparator 214 controls a transistor 224 which develops a travel interrupt signal. The circuitry of the travel interrupt control channel 212 will now be described in greater detail.

For the purpose of controlling the travel interrupt control channel 212, the height signal from the height sensor 52 is applied from the output of the amplifier 172 through a conductor 226 and a resistor 228 to the noninverting input of the comparator 214. The inverting input of the comparator 214 is connected with a reference voltage source comprising a voltage divider 232. The voltage divider 232 develops a changeable reference voltage which changes in accordance with the steering angle of the truck. The voltage divider 232 is connected in the steering signal circuit 216 which will be described presently. The steering signal circuit 216 includes the steering angle sensor 62 which comprises a potentiometer 66. The steering angle sensor 62 is coupled with the drive-steer wheel 14 in such a manner that the movable contact of the potentiometer 66 is positioned at the midpoint of the resistor when the drive-steer wheel 14 is straight ahead. Accordingly, for a given gear ratio in the steering gear, the range of steering angle from the maximum angle for a right-hand turn to the maximum for a left-hand turn will cause the wiper contact to sweep a range of 360 degrees. With a supply voltage of 10 volts on the potentiometer 66, the steering angle signal would be 5 volts for straight ahead, 10 volts for maximum right-hand steering angle and 0 volts for maximum left-hand steering angle. For a steering gear having a different gear ratio, the movable contact of the potentiometer 66 might sweep over a range of only 270 degrees. In this case, the steering angle signal would still be 5 volts for straight ahead but it would be a lesser voltage for maximum right-hand steering signal and a greater voltage for maximum left-hand steering signal. The steering signal from the steering sensor 62 is applied through a filter comprising a series resistor 234 and a shunt capacitor 236 to the noninverting input of a unity gain amplifier 238. The output of the amplifier 238 is applied through a resistor 242 to the steering signal indicator 46. The output of the amplifier 238 is also applied to the inverting input of the comparator 218 and to the noninverting input of the comparator 222. The comparator 218 is part of a reference switching circuit for establishing the steering angle limit for the right-hand turn and the comparator 222 is part of a reference switching circuit for establishing the limit for the left-hand steering angle. For this purpose, the noninverting input of the comparator 218 is connected through a resistor 244 to an adjustable contact on a voltage divider 246 which is connected across a source of reference voltage. The output of the comparator 218 is connected through a diode 248 and a resistor 252 to the noninverting input. The output is also connected through a diode 254 to the voltage divider 232. The voltage divider 232 comprises a fixed resistor 256, a potentiometer 258 and a fixed resistor 262 which are connected in series across a source of reference voltage. The movable contact of the potentiometer 258 is connected with the inverting input of the comparator 214, as previously described. A fixed resistor 264 is connected through a closed switch 266 between the diode 254 and the junction of potentiometer 258 and resistor 262. When the output of the comparator 218 goes to logic low, the resistor 264 is effectively connected in parallel with the resistor 262 thus switching the value of the reference voltage on the potentiometer 258 from a higher value to a lower value. The resistor 264 is used in the circuit for a truck having a wide range of steering angles whereas the resistor 268 is used in the circuit for a truck having a narrower range of steering angles, the selection being made by switches 266 and 272.

The comparator 222 of the reference switching circuit for establishing the limit of the left-hand steering angle, has its inverting input connected with another adjustable contact of the voltage divider 246. As previously mentioned, the steering signal is applied from the amplifier 238 through resistor 245 to the noninverting input of the comparator 222. The output of the comparator 222 is connected through a diode 274 and a resistor 276 to the noninverting input. Also, the output of the comparator 222 is connected through the diode 278 to the voltage divider 232, i.e. through the switch 266 and resistor 264. When the output of the comparator 222 goes to logic low, the resistor 264 is effectively connected across the resistor 262 thus switching the reference voltage produced by the voltage divider 232 from a higher value to a lower value.

The comparator 214, as previously described, receives the height signal voltage on its noninverting input and it receives the reference voltage from the voltage divider 232 on its inverting input. The output of the comparator 214 is connected through the diode 282 and the resistor 284 to the noninverting input. The output is also applied through a resistor 286 to the base of the transistor 224 which is connected to ground through a resistor 288. The emitter of the transistor 224 is connected to ground and the collector is connected through a conductor 289 to an input of the speed and direction control 88. The output of the transistor 224 is a travel interrupt signal which, when applied to the speed and direction control circuit 88, is effective to open the forward and reverse contractors thereby deenergizing the traction motor 24 to interrupt the travel of the truck.

The operation of the travel interrupt control channel 212 will now be described. The height signal from the height sensor 52 is applied to the noninverting input of the comparator 214, as previously described. Also, the changeable reference voltage from the voltage divider 232 is applied to the inverting input of the comparator 214. When the height signal is less than the reference signal, the output of the comparator 214 is at logic low and the transistor 224 is turned off. Thus, the travel interrupt signal on conductor 289 is high and does not affect the travel of the truck. If the steering angle of the truck is within the right-hand and left-hand steering angle limits, the steering angle signal applied to the input of the comparator 218 will be less than the reference input thereto and the steering angle singal at the input of comparator 222 will be greater than the reference input thereto. Accordingly, the outputs of both comparators 218 and 222 will be at logic high and the voltage divider 232 will be unaffected by the comparators. Under this condition, the reference voltage at the inverting input of the comparator 214 will be relatively high. Accordingly, the height signal will be less than the reference signal until the load forks of the truck are raised to a first predetermined travel interrupt height. At that height, the height signal will exceed the reference signal and the output of the comparator 214 will go to logic high. This will turn on the transistor 224 and cause the travel interrupt signal on conductor 289 to go to logic low. On the other hand, if the truck is turned to the right and the steering angle is greater than the right-hand steering angle limit, the steering signal at the input of comparator 218 will be greater than the reference signal. Accordingly, the output of the comparator 218 will go to logic low and the reference voltage at the inverting input of comparator 214 is switched to a relatively lower value. Thus, when the height signal exceeds a value corresponding to a second predetermined travel interrupt height, less than the first predetermined height, the output of the comparator 214 will go to logic high and the transistor 224 will produce a logic low interrupt signal to stop the travel of the truck. In the same manner, when the steering angle for a left-hand turn exceeds the limiting value as set by the reference voltage on comparator 222, the reference voltage at the input of this comparator will exceed a steering angle signal and the output of comparator 222 will go to logic low. This causes the comparator 214 and the transistor 224 to produce a logic low interrupt signal when the second predetermined height is reached and thereby interrupt the travel of the truck.

The lowering control channel for the extendible upright is shown in FIG. 7. This circuit includes manual control so that the operator can lower the load forks 32 at low speed or at high speed. However, automatic control is provided to interrupt lowering of the forks below a predetermined low speed interrupt height at low speed and to prevent lowering the forks below a predetermined high speed interrupt height at high speed. Manual override of the automatic control circuit is also provided. Additionally, this control circuit interrupts lowering at either high speed or low speed in the event that the forks encounter an obstacle.

The lowering control channel includes a low speed lowering circuit 292 which, in general, comprises a manual low speed lowering switch 294, a fork height limit control circuit 296 and a driver stage 298 for the low speed lowering control valve 74. The manual switch 294 has one contact connected with the battery voltage and is normally opened. A filter capacitor 302 is connected between the other switch contact and ground. The switch is connected through a conductor 304 and a resistor 306 to the base of a Darlington transistor 308. The solenoid winding 312 of the low speed lower valve 72 is connected to the collector of the transistor 308 and the emitter thereof is connected to ground. A varistor 314 is connected between the collector and ground for transient protection of the transistor. A switching transistor 316 is connected to the base of transistor 308 for automatic control purposes which will be described presently. Disregarding, for explanatory purposes, the effect of transistor 316, closing the manual switch 294 turns on the transistor 308 and actuates the low speed lower control valve 72.

The fork height limit control circuit 296 includes the switching transistor 316. The fork height limit control circuit 296 is adapted to automatically stop the lowering of the load forks for handling certain types of loads when the low speed interrupt height is reached. For this purpose, it includes a reference voltage circuit comprising a voltage divider 318 connected across the regulated 10 volt source. It also comprises a unity gain amplifier 322 having its input connected with the voltage divider 318 and having its output connected across a potentiometer 324. The movable contact of the potentiometer 324 is positioned so that the voltage thereon corresponds to a predetermined height of the load forks above the floor, say 24 inches. The limit control circuit 296 comprises a comparator 326 which has its noninverting input connected through a resistor 328 to the potentiometer 324. The inverting input of the comparator 326 receives the height signal from the height sensor 52. The output of the comparator 326 is connected through a resistor 332 to the noninverting input. The output is also connected to the first input of a NAND gate 334. The second input of the NAND gate 334 is connected to a lift/lower override circuit 336 which will be described subsequently. The output of the NAND gate 334 is connected to the input of an inverter 338, the output of which is connected to the first input of a NOR gate 342. The output of the comparator 326 is also connected with the first input of a gate 344 which has its second input connected with the lift/lower override circuit 336. The gate 344 is an AND gate with inverting inputs. The output of the gate 344 is connected with the second input of the NOR gate 342. The output of the NOR gate 342 is connected through a diode 346 and a resistor 348 to the base of the switching transistor 316.

Before describing the operation of the low speed lowering control circuit 292, it will be helpful to consider the lift/lower override circuit 336. This circuit is manually controlled and permits the operator to override the fork height limit control circuit 296 in such a manner that the load forks can be lowered below the low speed interrupt height after they have been stopped at that limit position. This override circuit comprises a push button override switch 352 with one fixed contact connected to the regulated voltage source and the other fixed contact connected through a resistor 354 to the second input of the gate 344. A filter for the override circuit includes shunt capacitors 356 and 358 and a shunt resistor 362.

The operation of the low speed lowering control circuit 292 is as follows. With the load forks 32 of the extendible upright 26 in an elevated position above the low speed interrupt height, the height signal is greater than the reference signal corresponding to the interrupt height. Thus, the logic state of the limit control circuit 296 is as follows. The height signal at the inverting input of comparator 326 is greater than the reference signal at the noninverting input and accordingly the output of the comparator is low. This causes the first input of the NAND gate 334 to be at logic low. The second input of the NAND gate 334 is low since the lift/lower override switch 352 is open. Accordingly, the output of the NAND gate 334 is high and the output of the inverter 338, and hence the first input of the NOR gate 342 is low. The second input of the NOR gate 342 is high since both the first and second inputs of the gate 344 are low. Accordingly, the output of the NOR gate 342 is low and thus the switching transistor 316 is turned off. In this state, the switching transistor 316 does not affect the transistor 308. Accordingly, when the operator closes the low speed lower switch 294 the transistor 308 is turned on and the solenoid winding 312 of the low speed lower valve 74 is energized. This allows the load forks 32 to descend at low speed as controlled by the valve 74 and the flow restrictor 75 (see FIG. 4).

When the load forks 42 descend to the low speed interrupt height, the height signal at the inverting input of the comparator 326 becomes less than the reference signal at the noninverting input. In this condition, the logic state of the limit control circuit 296 is as follows. The output of the comparator 326 is high; hence, the first input of the NAND gate 324 is high and the second input thereof remains low. Accordingly, the input of the inverter 338 is high and the first input of the NOR gate 342 is low. The second input of the NOR gate 342 is also low since the first input of the gate 344 is high and the second input thereof is low. Thus, the output of the NOR gate 342 is high and the switching transistor is turned on. This short circuits the base emitter input of transistor 308 to ground and hence the transistor 308 is turned off even though the manual low speed lowering switch 294 is closed. Accordingly, the low speed lowering valve 74 is deactuated and the descent of the load forks 32 is stopped at the low speed interrupt height.

If the operator desires to lower the lift forks 32 below the low speed interrupt height, he can do so by closing the lift/lower override switch 352. This causes the second input of the NAND gate 334 and the second input of the gate 344 to go to logic high. Consequently, the input to the inverter 338 is low and the first input to the NOR gate 342 is high while the second input thereof is low. Thus, the output of the NOR gate 342 goes low and the switching transistor 316 is turned off. Thus, closing the manual low speed lowering switch 294 is effective to turn on the transistor 308 and reactuate the low speed lower valve 74 to permit the load forks 32 to descend below the low speed interrupt height. It is to be noted however, that the operator cannot defeat the purpose of the limit control circuit 296 by taping or otherwise holding the push button override switch 352 closed. When this switch is closed and the load forks are above the interrupt height, the output of the NAND gate 334 is high and hence the first input of the NOR gate 342 is low. The second input of the NOR gate 342 is also low and hence the output thereof is high. This turns the switching transistor 316 on and thus prevents transistor 308 from being turned on by the manual switch 294 to actuate the low speed lowering valve 74.

The high speed lowering control circuit 372 comprises a manual high speed lowering switch 374, a fork height limit control circuit 376 and a driver stage 378. The manual switch 374 has one contact connected to the battery voltage and the other contact is connected with a filter capacitor 382 and the conductor 384 through a resistor 386 to the base of a Darlington transistor 388 in the driver stage 378. The collector of the Darlington transistor 388 is connected with the solenoid winding 392 of the high speed lowering control valve 74. The emitter of transistor 388 is connected to ground. A varistor 394 is connected between the collector and ground for transient protection.

The fork height limit control circuit 376 comprises a comparator 396 and a switching transistor 398. The inverting input of the comparator 396 receives the height signal from the height sensor 52 and the noninverting input receives a reference voltage from the voltage divider 318 through the unity gain amplifier 322 and a resistor 402. The output of the comparator 396 is connected through a resistor 404 with the noninverting input. The output of the comparator 396 is also connected through a diode 406 and a resistor 408 to the base of the switching transistor 398.

The operation of the high speed lowering control circuit 372 is as follows. The reference voltage applied to the comparator 396 is derived from the voltage divider 318 and establishes the high speed interrupt height. This reference voltage is, of course, higher than that applied to the comparator 326 in the low speed circuit so that the high speed limit circuit will stop the descent of the load forks 32 at say 36 inches above the floor. When the height signal at the inverting input of the comparator 396 is greater than the reference signal, the output of the comparator 396 is low. Accordingly, the switching transistor 398 is turned off. In this condition, the load forks can be lowered at high speed by closing switch 374 which turns on the Darlington transistor 388 and energizes the solenoid winding 392 of the high speed lowering control valve 74. When the load forks 32 descend to the high speed interrupt height, the height signal will become less than the reference signal and the output of the comparator 396 will go to logic high. This turns on the switching transistor 398 and thereby shorts the base of transistor 388 to ground. Transistor 388 is turned off and the high speed lowering control valve 74 is deenergized. Thus, the load forks 32 are automatically stopped at the high speed interrupt height. The operator may lower the forks from this height by closing the low speed lowering switch to cause the forks to be lowered at low speed under the control of the low speed lowering circuit 292, as described above.

The obstruction interrupt circuit 412 is also shown in FIG. 7. This circuit comprises an obstruction sensor in the form of a no-slack switch 414 which is normally closed but which is opened when the load forks 32 engage an obstacle during lowering of the forks. The switch 414 is actuated by the lift chain 415 (see FIG. 1) when it becomes slack as a result of an obstruction. The switch 414 has one contact connected with the battery voltage the other contact is connected with a filter circuit 416 and to an inverter 418. The output of the inverter 418 is connected through a diode 422 and a resistor 423 to the base of switching transistor 316. The base of the transistor 316 is connected through a resistor 424 to ground. The output of the inverter 418 is also connected through a diode 426 and a resistor 427 to the base of switching transistor 398. The base of transistor 398 is connected through a resistor 428 to ground.

The operation of the obstruction interrupt circuit 412 is as follows. When the switch 414 is closed, the output of the inverter 418 is low and the circuit does not affect either switching transistor 316 or switching transistor 398. However, when the switch 414 is opened the output of the inverter 418 goes high and this turns on the switching transistor 316 and the switching transistor 398. As a result, both the low speed lowering control valve 74 and the high speed lowering control valve 76 are prevented from being energized. Thus, whichever control valve 74 or 76 was energized at the time of engagement of obstruction, will be deenergized and the descent of the load forks is stopped.

The lift control channel for the extendible upright is shown in FIG. 8 and is similar to the lowering control channel previously described. This circuit includes manual control so that the operator can raise the load forks 32 at low speed or at high speed. Automatic control is provided to permit raising the forks at high speed up to above a high speed interrupt height and then to continue at low speed operation. Also, the automatic control prevents raising the forks above preset lift interrupt height without manual override. Manual override of the automatic control circuit for the low speed operation is provided. Additionally, this control channel includes a battery condition circuit which disables the lifting function in the event of low battery voltage.

The lift control channel includes a low speed lift control circuit 432 which, in general, comprises a manual low speed lift switch 434, a fork height limit control circuit 436 and a driver stage 438 for the coil 122 of the contactor 98 of the low speed lift pump motor 96 and the solenoid winding 116 of the dump valve 118. The manual switch 434 has one contact connected with the battery voltage and is normally open. A filter capacitor 442 is connected between the other switch contact and ground. The switch is connected through a conductor 444 and a resistor 446 to the base of a Darlington transistor 448. The coil 122 and winding 116 are connected to the collector of the transistor 448 and the emitter thereof is connected to ground. A varistor 452 is connected between the collector and ground for transient protection. A switching transistor 454 is connected to the base of transistor 448 for automatic control purposes which will be described presently. If the switching transistor 454 is turned off, closing of the manual switch 434 turns on the transistor 448 and energizes the solenoid 116 and coil 122 which actuates the low speed lift pump motor and the dump valve.

The fork height limit control circuit 436 includes the switching transistor 454. This control circuit is adapted to automatically interrupt the load forks when a predetermined lift interrupt height above the floor is reached. For this purpose, it includes a reference voltage circuit comprising a voltage divider 456 connected across the regulated 10 volt source. The movable contact of the voltage divider 456 is positioned so that the voltage thereon corresponds to the lift interrupt height of the load forks above the floor say 190 inches. The limit control circuit 436 comprises a comparator 458 which has its inverting input connected to the voltage divider 456. The noninverting input of the comparator 458 is connected through a resistor 462 to the height sensor 52 and receives the height signal. The output of the comparator 458 is connected through a resistor 464 to its noninverting input. The output is also connected to the first input of a NAND gate 466. The second input of the NAND gate 466 is connected to the lift/lower override circuit 336 which was described previously. The output of the NAND gate 466 is connected through an inverter 468 to the first input of a NOR gate 472. The output of the comparator 458 is also connected to the first input of a gate 474 which has its second input connected with the override circuit 336. Gate 474 is an AND gate with inverted inputs. The output of the gate 474 is connected with the second input of the NOR gate 472. The output of the NOR gate 472 is connected through a diode 476 and a resistor 478 to the base of the switching transistor 454. Before describing the operation of the lift control circuit 432, the high speed lift control circuit 482 will be described.

The high speed lift control circuit 482 comprises a manual high speed lift switch 484, a a high speed lift interrupt circuit 486 and a driver stage 488. The manual switch 484 has one contact connected to the battery voltage and the other contact is connected with a filter capacitor 492 and through a conductor 494 and resistor 496 to the base of a Darlington transistor 498 in the driver stage 488. The collector of the Darlington transistor 488 is connected with the coil 502 of the contactor 104 for the high speed pump motor 102. The emitter of the transistor 498 is connected to ground. A varistor 504 is connected between the collector and ground for transient protection.

The high speed lift interrupt circuit 486 comprises a comparator 506 and a switching transistor 508. A voltage divider 512 is connected across the regulated voltage source and is provided with a movable contact which is adjusted to provide a reference voltage corresponding to the high speed lift interrupt height. The movable contact of the voltage divider 512 is connected to the inverting input of the comparator 506. The noninverting input of the comparator 506 is connected through a resistor 514 with the height sensor and receives the height signal. The output of the comparator 506 is connected through a resistor 516 to the noninverting input. The output is also connected through a diode 518 and a resistor 522 to the base of the switching transistor 508. For purposes which will be described subsequently the low speed fork height limit control circuit 436 is coupled to the high speed lift interrupt circuit 486. This is provided by connecting the output of the NOR gate 472 through a diode 524 and a resistor 526 to the base of the switching transistor 508.

As discussed previously, a battery condition sensor 136 senses the condition of the battery 82 and produces a logic high battery condition signal when the voltage of the battery is less than say 80 percent of its rated voltage. Under such a low battery condition, it is desirable to disable the lifting function of the extendible upright. For this purpose, a lift disabling circuit 532 is provided as shown in FIG. 8. The battery condition signal from the battery sensor 136 is applied across a pair of voltage divider resistors 534 and 536. The junction of these resistors is connected through an inverter 538 and through a diode 542 and resistor 544 to the base of the switching transistor 454. The base of the transistor 454 is connected to ground through a resistor 546. Also, the battery condition signal is applied from the output of the inverter 538 through a diode 548 and a resistor 552 to the base of the switching transistor 508. The base of transistor 508 is connected to ground through a resistor 554.

The operation of the high speed lift control circuit 482, the low speed lift control circuit 432 and the lift disabling circuit 532 will now be described. It is noted that the low speed lift switch 434 and the high speed lift switch 484 are actuated by the manually controlled lift/lower lever 42 and are actuated in sequence. When the lift forks are to be raised, the operator can move the lift/lower lever 42 to the low speed lift position in which case the low speed lift switch 434 is closed. If the lever is moved to the high speed lift position the low speed lift switch 434 remains closed and the high speed lift switch 484 is also closed. The fork height limit control circuit 436 is provided so that the lift height of the load forks can be set to a predetermined limit value according to the clearance height of the building in which the truck is working. For example, if an operator is to use the same truck in two different buildings, one with a clearance height 200 inches and the other with a clearance height of 300 inches, the limit control circuit 436 would be set to limit the height to say 190 inches. Then, as the operator moves, the truck to the other building with a clearance height of 300 inches, the fork can be raised above the 190 inch limit only if the operator closes the lift/lower override switch 352. On the other hand, the high speed lift interrupt control circuit 486 is automatically operable to cut out the high speed lift at a predetermined height, say 12 inches below the maximum height but the low speed lift continues to be operable up to the maximum set height. This operation will be described in greater detail below.

With the load forks 32 of the extendible upright 26 in a position below the lift interrupt height set on voltage divider 456, the height signal on the height sensor 52 at the noninverting input of the comparator 458 is less than the reference signal from the voltage divider 456 on the inverting input. Thus, the output of the comparator 458 is low. This causes the first input of the NAND gate 466 to be low and the second input thereof which is connected to the override switch is also low. The output of the NAND gate 466 is high and thus the inverter 468 applies a logic low to the first input of the NOR gate 472. The second input of the NOR gate 472 receives the output of the gate 474 which is high. Thus, the output of the NOR gate is low. This low output is ineffective to turn on either switching transistor 454 or switching transistor 508. Assuming that the battery voltage is above the predetermined value, the battery condition signal from the sensor 136 is high. This signal is inverted by the inverter 538 and is ineffective to turn on the switching transistors 454 and 508. Thus, in this condition, the operator can raise the lift forks 32 at either low speed or high speed by manual control of the lift/lower lever 42. Assuming that the operator moves the lift/-lower lever 42 to the high speed lift position, both the low speed lift switch 434 and the high speed lift switch 484 will be closed. Closure of the switch 434 turns on the transistor 448 and thus energizes the coil 122 which closes the contactor 98 and turns on the low speed pump motor 98 and pump 54. At the same time transistor 448 energizes the dump solenoid winding 116 which closes the dump value 118. (The dump valve is operative to divert the output of the low speed pump 54 and high speed pump 56 to the sump tank and the valve is normally open to provide a fail-safe condition in the event that the contactors 98 and 104 for the pump motors should weld in a closed condition.) Closure of the high speed lift switch 484 turns on the transistor 498 which causes energization of the coil 502 of the contactor 104 which turns on the high speed motor 102 and pump 56. Thus, the load forks 42 are raised at high speed. Assume that the lift interrupt height is set by the voltage divider 456 at a limiting height, say 190 inches, which is less than the maximum possible height of 300 inches. When the lift interrupt height is reached, the height signal will become greater than the reference signal at the comparator 458. Accordingly, the output of the comparator will go high. The output of the NAND gate 466 remains high and the first input of the NOR gate 472 remains low. However, the second input of the NOR gate 472 goes low and the output thereof goes high. Accordingly, the switching transistor 454 is turned on and the switching transistor 508 is turned on. As a result, transistors 448 and 498 are turned off and both the low speed and high speed pumps are stopped and the forks are stopped at the lift interrupt height. The operator can raise the forks above this height by closing the override switch 352 which is effective through the NAND gate 474 and NOR gate 472 to turn off the switching transistors 454 and 508 and thereby reenergize the low speed and high speed pumps. In the foregoing operation, the load forks have not yet reached the high speed lift interrupt height which is set by the voltage divider 512. Accordingly, the output of the comparator 506 is low during such operation and thus ineffective to turn on the switching transistor 508. However, when the high speed lift interrupt height is reached, say 12 inches below the maximum height, the height signal is greater than the reference signal at the comparator 506. Accordingly, the output of the comparator goes high and the swithcing transistor 508 is turned on. As a result, transistor 498 is turned off and the high speed pump is turned off. The motion of the forks continues upward at low speed until the maximum height is reached at which the fluid motor 28 is fully extended.

As mentioned above, the circuit board 84 also includes an overload warning circuit 562. This circuit is adapted to energize the overload warning horn 64 when the load on the forks 32 exceeds a predetermined value, except during lifting or lowering. This circuit comprises an overload sensor in the form of a pressure reponsive switch 564 which is responsive to pressure in the fluid motor 28. The switch 564 is normally open and is closed when the pressure reaches the predetermined value. One terminal of the switch 564 is connected with the battery voltage and the other terminal is connected across a filter capacitor 566 to a timing circuit 568. The timing circuit 568 comprises a pair of series resistors 572 and 574 in a charging circuit for a shunt capacitor 576. a discharging circuit for the shunt capacitor 576 comprises a diode 578 and a resistor 582. The junction of resistors 572 and 574 is clamped to 12 volts by connection through a diode 583 to the regulated 12 volt source. The output of the timing circuit 568 is taken across the capacitor 576 and applied to the second input of a NAND gate 584. A horn disabling circuit 586 has its output connected with the first input of the NAND gate 584. The disabling circuit comprises a pair of voltage divider resistors 588 and 592 connected across the battery voltage through a diode 594 and the low speed lowering switch 294 and also through a diode 596 and the low speed lift switch 434. The junction of the voltge divider resistors 588 and 592 is connected across a filter capacitor 598 to the input of an inverter 602 the output of which is connected to the first input of the NAND gate 584. The output of the NAND gate 584 is connected through an inverter 604 and a resistor 606 to the base of a Darlington transistor 608. The base is connected to ground through a resistor 612. The collector of the transistor 608 is connected through the warning horn 64 to ground and a varistor 614 is connected between the collector and ground for transient protection. The emitter of the transistor 608 is connected to ground.

The operation of the overload warning circuit is as follows. Assume that the operator has lifted a load on the lift forks 32 and has returned the lift/lower level 42 to neutral thereby opening both lift switches 434 and 484. In this condition, the input of the inverter 602 will be low and the first input of the NAND gate 584 will be high. When the load on the forks is less than the predetermined or overload value, the pressure responsive switch 564 will be open. Accordingly, the second input of the NAND gate 584 will be low. The output of the NAND gate 584 will be high and the output of the inverter 684 will be low. Thus, the Darlington transistor 608 will be turned off and the warning horn 64 will not be energized. If, however, the load on the lift forks 32 exceeds the overload value, the switch 564 will be closed and the battery voltage will be applied to the timing circuit 568 with the voltage being clamped at 12 volts through the diode 583. After a time delay of about 3 seconds, the capacitor 576 charges to a logic high which is applied to the second input of the NAND gate 584. The time delay is provided by the timing circuit to prevent overload warning in the event of the transient high pressure value in the fluid motor 28. When the pressure switch 564 is opened, the capacitor 576 discharges quickly through the diode 578 and the resistor 582, thus placing the circuit in readiness for another cycle. The logic high voltage across capacitor 576 is applied to the second input of the NAND gate 584 and hence the output thereof goes to logic low. The output of the inverter 684 goes to logic high and turns on the transistor 608 to energize the warning horn 64. In the event the operator closes either the low speed lift switch 434 or the low speed lowering switch 294, the first input of the NAND gate 584 goes to logic low causing the transistor 608 to turn on and thereby turn off the warning horn 64 during the low speed lift or low speed lower operation.

Although the description of this invention has been given with reference to a particular embodiment, it is not to be construed in the limiting sense. Many variations and modifications will now occur to those skilled in the art. For a definition of the invention reference is made to the appended claims.

What is claimed is:

1. In a lift truck of the type comprising an electric traction motor, manually controlled speed signal generating means for generating a speed command signal voltage varying inversely with a desired speed, an extendible upright, and control means for said motor responsive to a speed control voltage for controlling the speed of said motor, the improvement comprising:

height signal generating means operatively coupled with said upright for generating a height signal voltage varying directly with the amount of extension of said upright, logic means responsive to said speed command signal voltage and to said height signal voltage for producing the speed control voltage corresponding to the value of the larger of said signal voltages, and means for applying said speed control voltage to said control means whereby the speed of said motor is governed by only one of said signal voltages.

2. The invention as defined in claim 1 wherein said lift truck also includes a manually controlled low speed lowering means for said upright, said improvement further comprising:

a first reference voltage generating means for generating a first reference voltage corresponding to a first lower limit of height for said upright, first comparing means for comparing said first reference voltage with said height signal voltage, and logic means coupled with said first comparing means for disabling said lowering means when the height of the upright corresponds to said first lower limit.

3. The invention as defined in claim 2 including a manual override switch coupled with said logic means for preventing said logic means from disabling said lowering means.

4. The invention as defined in claim 2 wherein said lift truck also includes a manually controlled high speed lowering means for said upright, said improvement further comprising:

a second reference voltage generating means for generating a second reference voltage corresponding to a second lower limit of said upright, second comparing means for comparing said second reference voltage with said height signal voltage for producing a disabling signal voltage when said height signal voltage corresponds to said second lower limit, and switching means responsive to said disabling signal voltage for disabling said high speed lowering means.

5. The invention as defined in claim 2 wherein said lift truck also includes a sensing means for sensing an obstruction in the lowering of said extendible upright, said improvement further comprising:

means for coupling said sensing means with said logic means to disable said low speed lowering means.

6. The invention as defined in claim 1 wherein said lift truck also includes a manually controlled low speed lift means for said upright, said improvement further comprising:

reference voltage generating means for generating a lift interrupt height signal voltage, and comparing means for comparing the lift interrupt height signal voltage and said height signal voltage and for disabling said low speed lift means when the height signal voltage exceeds said lift interrupt height signal voltage.

7. The invention as defined in claim 1 wherein said lift truck also includes a manually controlled high speed lift means for said upright, said improvement further comprising:

reference voltage generating means for generating a high speed lift interrupt height signal voltage, and comparing means for comparing the high speed lift interrupt height signal voltage and said height signal voltage and for disabling said high speed lift means when said height signal voltage exceeds said high speed lift interrupt height signal voltage.

8. The invention as defined in claim 1 wherein said lift truck also includes manually controlled low speed lift means and manually controlled high speed lift means for said upright, said improvement further comprising:

first electronic switching means for controlling said low speed lift means and second electronic switching means for controlling said high speed lift means, and battery voltage responsive means for preventing the turn-on of said first and second electronic switching means when said battery voltage is less than a predetermined value.

9. The invention as defined in claim 1 wherein said lift truck also includes a hydraulic lift circuit for extending said upright, said improvement further comprising:

pressure sensing means coupled with said hydraulic circuit for producing an overload signal when the hydraulic pressure exceeds a predetermined value, alarm means for warning the operator of an overload, switching means responsive to said overload signal for energizing said alarm means, and logic means responsive to said low speed lift signal and said low speed lower signal for disabling said switching means.

10. In a lift truck of the type comprising an electric traction motor, a manually controlled speed signal generating means for generating a speed command signal corresponding to a desired speed, an extendible upright, control means for said motor responsive to a speed control voltage for controlling the speed of said motor, a manually controlled dirigible wheel and lift means for extending said upright, the improvement comprising:

height signal generating means operatively coupled with said upright for generating a height signal voltage corresponding to the amount of extension of said upright, logic means responsive to said speed command signal voltage and to said height signal voltage for producing the speed control voltage corresponding to the value of the larger of said signal voltages, means for applying said speed control voltage to said control means whereby the speed of said motor is governed by only one of said signal voltages, steering signal generating means for generating a steering signal voltage corresponding to a steering angle of said dirigible wheel, and travel interrupt control means responsive to said steering signal voltage for deenergizing said motor to stop said lift truck when the steering signal voltage exceeds a predetermined value.

* * * * *